US006446535B1

(12) United States Patent
Sanford et al.

(10) Patent No.: US 6,446,535 B1
(45) Date of Patent: Sep. 10, 2002

(54) TRIPLE-TUBE, DISPERSIBLE COUNTERMASS RECOILLESS PROJECTILE LAUNCHER SYSTEM

(75) Inventors: Matthew J. Sanford, Bel Alton, MD (US); Gregory D. DuChane, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 76 days.

(21) Appl. No.: 09/784,105

(22) Filed: Feb. 16, 2001

(51) Int. Cl.[7] ..... F41A 1/08
(52) U.S. Cl. ..... 89/1.701; 89/1.702
(58) Field of Search ..... 89/1.701, 1.702, 89/1.7

(56) References Cited

U.S. PATENT DOCUMENTS

| | | | | |
|---|---|---|---|---|
| 4,132,148 A | * | 1/1979 | Meistring et al. | 89/1.701 |
| 4,643,071 A | * | 2/1987 | Baechler et al. | 89/1.701 |
| 4,759,430 A | | 7/1988 | Kalin | 188/377 |
| 5,285,713 A | | 2/1994 | Brage | 89/1.704 |
| 5,322,002 A | | 6/1994 | Miskelly, Jr. et al. | 89/8 |
| 5,491,917 A | | 2/1996 | Dilhan et al. | 42/106 |
| 5,551,330 A | | 9/1996 | Reuche | 89/1.701 |
| 5,952,601 A | | 9/1999 | Sanford et al. | 89/1.706 |
| 6,286,408 B1 | * | 9/2001 | Sanford et al. | 89/1.7 |

* cited by examiner

*Primary Examiner*—J. Woodrow Eldred
(74) *Attorney, Agent, or Firm*—James B. Bechtel, Esq.; Peter J. Van Bergen, Esq.

(57) ABSTRACT

A recoilless projectile launcher system has a projectile residing in a launch tube with a propellant charge coupled to the aft end of the projectile. A first tube is slidingly fitted in the launch tube, is coupled to the aft end of the projectile, and encases the propellant charge. The first tube has a first portion extending from the propellant charge and a second portion extending from the first portion towards the breech end. The first portion has a constant inside diameter while the second portion has a reduced inside diameter relative to the constant inside diameter of the first portion. A piston, slidingly fitted in the first portion of the first tube, is positioned adjacent the propellant charge. A second tube is coupled to the piston and extends towards the launch tube's breech end. The second tube has a constant inside diameter and a constant outside diameter with the constant outside diameter forming a sliding fit with the second portion of the first tube. A dispersible countermass resides in the second tube and is dimensionally stable independent of the second tube.

26 Claims, 5 Drawing Sheets

502A
502
502B
508B
516
512B
514-N
512
514-N
514
508A
514-2
514-1
508
510
506
504

516
514-N
502B
512
508B
508A
510
508
520
502
504
502A 514-3
514-2
514-1
514-4
502B
512
508B
510
508
502
508
520
504
502A

TRIPLE-TUBE, DISPERSIBLE COUNTERMASS RECOILLESS PROJECTILE LAUNCHER SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to recoilless projectile launchers, and more particularly to a recoilless projectile launcher system using three tubes and a dispersible countermass.

BACKGROUND OF THE INVENTION

Recoilless launchers are generally categorized based on their system of propulsion. In rocket motor-based propulsion systems, the motor's hot toxic gases, smoke and sound are directed out the rear of the launch tube. For obvious safety reasons, this prohibits this type of recoilless launcher from being used in enclosed spaces. In powder charge-based propulsion systems, a countermass mounted in the launch tube is pushed out the rear thereof as the projectile is pushed out the forward end thereof. The countermass is generally designed to disperse harmlessly upon exiting the launch tube. The propulsion gases may or may not be vented, but are generally lesser in quantity when compared with rocket motor-based propulsion systems. Examples of countermass systems for use in powder charge-based propulsion systems are disclosed in U.S. Pat. Nos. 4,759,430 and 5,952,601.

In each of the above-noted patented systems, a piston pushes on a dispersible countermass as the powder charge burns. More specifically, in U.S. Pat. No. 4,759,430, an iron powder countermass is maintained in a cartridge attached to the piston. The piston and cartridge are propelled towards the launcher's breech end where the piston is arrested and the iron powder flies from the cartridge. In U.S. Pat. No. 5,952,601, a liquid countermass is maintained in a pressure vessel designed to fly with the launched projectile. A piston mounted in the pressure vessel applies pressure to the liquid countermass causing it to exit the launch tube. However, both systems use the countermasses that generate radial or side loading since they are dimensionally unstable substances, i.e., they are only held in place by a container. The side loading forces can be transferred to the launch tube and, ultimately, to the launch personnel thereby effecting the launch and possibly injuring the launch personnel.

SUMMARY OF THE INVENTION

Accordingly, it is an object of the present invention to provide a recoilless projectile launcher system.

Another object of the present invention to provide a recoilless projectile launcher system for use in powder charge-based propulsion launchers.

Still another object of the present invention to provide a counter mass-based recoilless projectile launcher system that eliminates side loading as the countermass is propelled from the launch tube.

Other objects and advantages of the present invention will become more obvious hereinafter in the specification and drawings.

In accordance with the present invention, a recoilless projectile launcher system has a launch tube open at muzzle and breech ends thereof. A projectile residing in the launch tube has a forward end pointing towards the launch tube's muzzle end and having an aft end pointing towards the launch tube's breech end. A propellant charge is coupled to the aft end of the projectile. A first tube is slidingly fitted in the launch tube, is coupled to the aft end of the projectile, and encases the propellant charge. The first tube has a first portion extending from the propellant charge towards the launch tube's breech end and has a second portion extending from the first portion towards the breech end. The first portion has a constant inside diameter while the second portion has a reduced inside diameter relative to the constant inside diameter of the first portion. A piston, slidingly fitted in the first portion of the first tube, is positioned adjacent the propellant charge. A second tube is coupled to the piston and extends towards the launch tube's breech end. The second tube has a constant inside diameter and a constant outside diameter with the constant outside diameter forming a sliding fit with the second portion of the first tube. A dispersible countermass resides in the second tube and is dimensionally stable independent of the second tube.

DETAILED DESCRIPTION OF THE INVENTION

Figures 1, 2, 3:
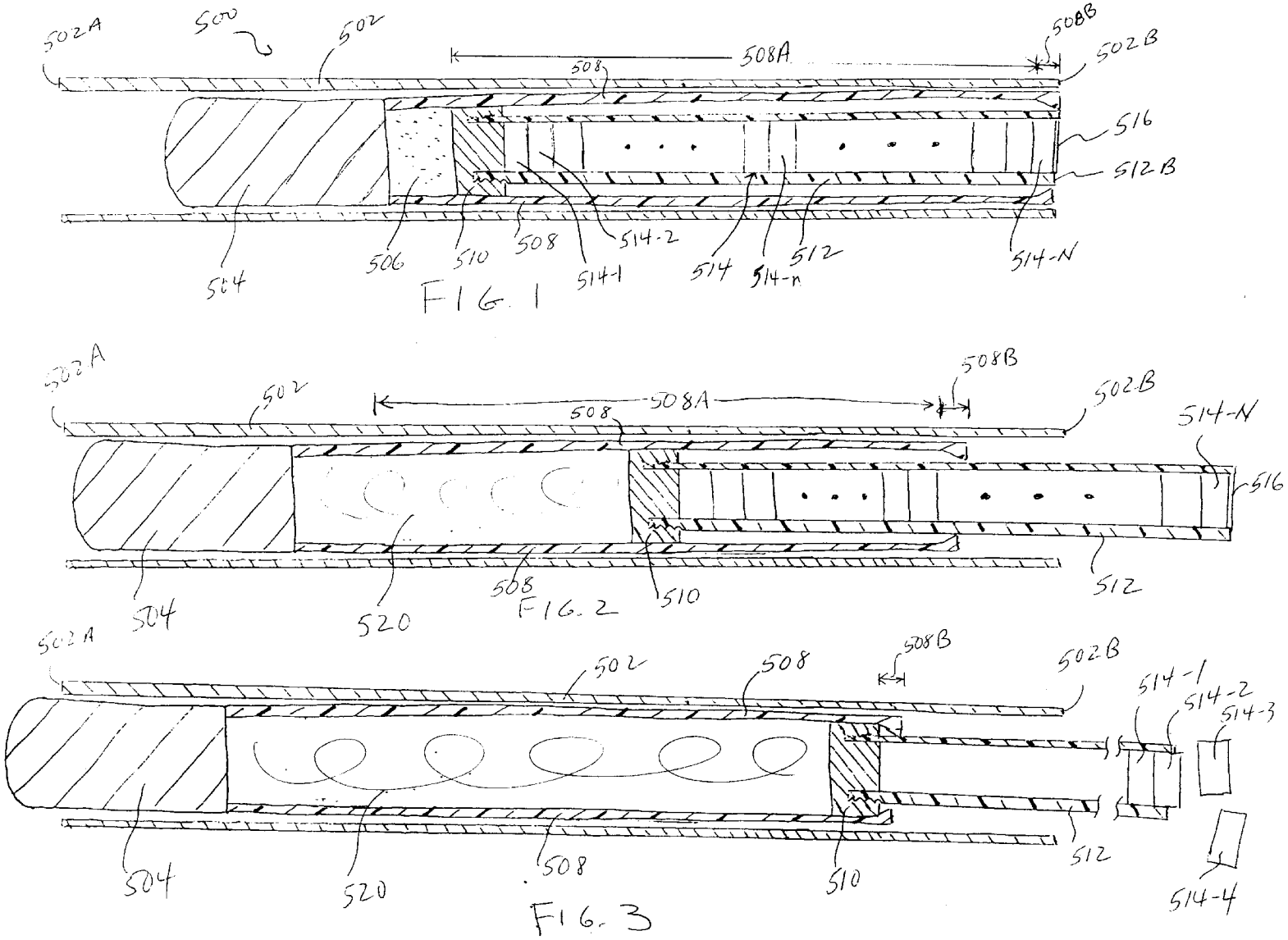
FIG. 1 is a cross-sectional view of an embodiment of a triple-tube, dispersible countermass, recoilless projectile launcher system prior to launch according to the present invention.
FIG. 2 is a cross-sectional view of the recoilless projectile launcher system after the propellant charge has begun to burn but prior to release of the countermass.
FIG. 3 is a cross-sectional view of the recoilless projectile launcher system as the countermass is being released.

Referring now to the drawings, and more particularly to FIG. 1, a cross-sectional view of one embodiment of a triple-tube, dispersible countermass, recoilless projectile launcher system is shown and referenced generally by numeral 500. Launcher system 500 can be implemented with any hand-held or free-standing launch system, and is especially useful in confined or enclosed spaces where countermass discharge is of concern.

Launcher system 500 has an outer launch tube 502 having a muzzle end 502A and a breech end 502B. Residing in launch tube 502 is a projectile 504, the choice of which is not a limitation of the present invention. During launch, projectile 504 will exit muzzle end 502A. Coupled to the aft end of projectile 504 is a propellant charge 506. The type of propellant charge 506 and mechanism used for coupling same to projectile 504 are well understood in the art and are not limitations of the present invention. Typically, propellant charge 506 is a powder-based charge. Also, the mechanisms used to initiate propellant charge 506 do not have an impact on the present invention and have, therefore, been omitted for clarity of illustration.

Coupled to projectile 504 and encasing propellant charge 506 is a pressure tube 508 that extends towards breech end 502B. As will be explained further below, pressure tube 508 must contain the pressures developed by a burning propellant charge 506 and must travel with projectile 504 at launch. Accordingly, pressure tube 508 must be strong and lightweight. Materials satisfying this criteria include carbon-based materials, or man-made fiber materials such as materials made with fibers manufactured by Allied Signal Inc. under the registered trademark SPECTRA, or fibers manufactured by E. I. DuPont De Nemours and Company under the registered trademark KEVLAR.

Aft of propellant charge 506, pressure tube 508 is defined by a constant inside diameter up to the aft end thereof. More specifically, pressure tube 508 has a constant inside diameter along the region defined by reference numeral 508A. Aft of region 508A, pressure tube 508 defines a reduced diameter region 508B that defines a smaller inside diameter relative to region 508A. Region 508B can be formed by, for example, a gradual thickening of the tube wall in this region as shown. Other options for creating region 508B could include the attachment or integration of an inwardly extending annular flange or the attachment or integration of a conical flange. The purpose for reduced diameter region 508B will be explained further below.

Slidingly fitted in region 508A of pressure tube 508 is a piston 510 which, prior to launch, is positioned adjacent propellant charge 506 as shown in FIG. 1. The fit between pressure tube 508 and piston 510 is one that allows sliding movement of piston 510 in pressure tube 508 when pressure is applied thereto, while forming a seal against pressure tube 508 that prevents the passage of propellant gases. Such fits are well understood in the art and will, therefore, not be discussed further herein.

Coupled to piston 510 is a countermass tube 512 that extends from piston 510 towards breech end 502A. Such coupling can be achieved in a variety of ways and is not a limitation of the present invention. For example, as illustrated, countermass tube 512 is threaded into piston 510. Aft of piston 510, countermass tube 512 defines a constant inside diameter along its length and contains a dispersible countermass assembly 514 that will be explained further below. Also, aft of piston 510, countermass tube 512 defines a constant outer diameter that will slidingly fit through reduced diameter region 508B. Prior to launch, the aft end 512B of countermass tube 512 can rest in region 508B in order to support countermass tube 512.

In the present invention, tube 512 will also travel with projectile 504 and pressure tube 508. Accordingly, countermass tube 512 is not only be made of lightweight material (e.g., the same or similar to that used for pressure tube 508), but is also ideally made from as little material as possible. However, if countermass tube 512 contains a dispersible countermass that can expand hydrostatically (i.e., in all directions to include radially with respect to the launch direction) during launch, then countermass tube 512 must be made with thick enough walls to contain such hydrostatic forces or launch system 500 could experience dangerous side loading.

The present invention overcomes the weight (of countermass tube 512) and side loading concerns through the use of a dispersible countermass assembly 514 that is dimensionally stable independent of countermass tube 512. Further, countermass assembly 514 is one that is not subject to any appreciable radial expansion when axial load forces are applied thereto. Accordingly, countermass tube 512 need only serve as a guide for countermass assembly 514 during launch.

Dispersible countermass assembly 514 could be realized by a cylindrical stack of disks 514-1, 514-2, . . . , 514-n, . . . , 514-N. Each disk could be made from a dimensionally stable material (e.g., plastic, composite, etc.). Adjacent disks could be lightly tacked to one another such that they release from one another when exiting countermass tube 512. Another option is to allow all disks to loosely reside in countermass tube 512 and provide a frangible seal 516 over the aft end 512B of countermass tube 512. The fit between countermass assembly 514 and countermass tube 512 should be a low friction fit.

When propellant charge 506 begins to burn and generate propulsion gases 520 (FIG. 2), piston 510 is driven through region 508A of pressure tube 508 while countermass tube 512 is driven from breech end 502B. The combination of piston 510/countermass tube 512/countermass assembly 514 move aft until piston 512 abuts reduced diameter region 508B. Note that during this time, acceleration forces are not acting on countermass assembly 514. At the same time, projectile 504 and pressure tube 508 begin to move toward muzzle end 502A.

Once piston 510 abuts reduced diameter region 508B, countermass tube 512 begins to move forward with projectile 504 and pressure tube 508. Since countermass assembly 514 is only loosely packed in countermass tube 512, aft-directed acceleration forces transfer easily thereto causing it to exit countermass tube 512 and disperse as illustrated in FIG. 3.

Figure 4:
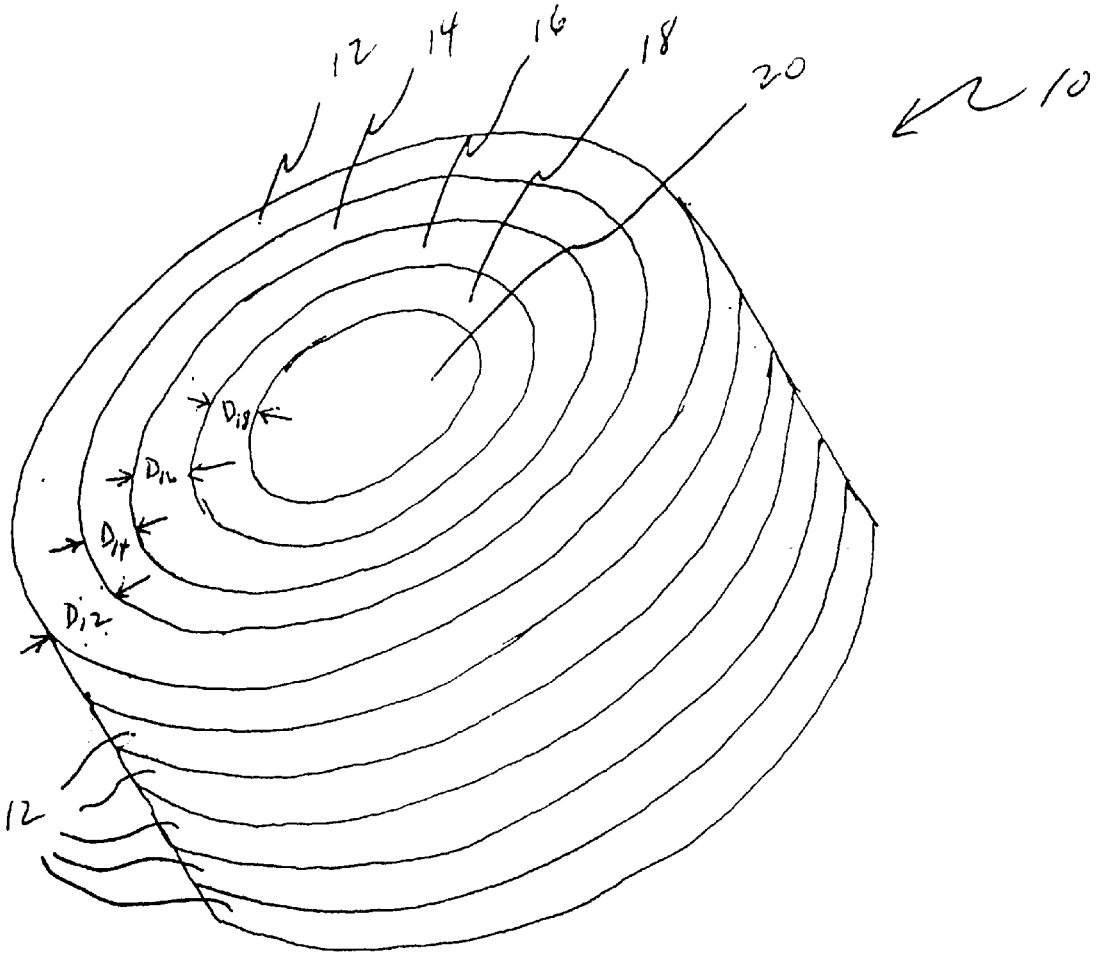
FIG. 4 is a perspective view of a stack of nested ring assemblies forming another embodiment of a dimensionally stable countermass assembly for use in the present invention.

Another embodiment of a countermass assembly that can be used in the present invention is shown in FIG. 4 and is referenced generally by numeral 10. Countermass assembly 10 is a dispersible countermass that is independently dimensionally stable in accordance with the present invention. Countermass assembly 10 is described in detail in U.S. patent application Ser. No. 09/708,252, filed Nov. 8, 2000, by the same inventors as the present application.

Countermass assembly 10 is a layered stack of nested rings. More specifically, each layer of countermass assembly 10 consists of a series of individual rings 12, 14, 16 and 18 successively nested with one another. Only the top layer is visible in FIG. 1. Although four such rings are shown in each layer of the illustrated embodiment, more or fewer individual rings can be used. The diametric thickness (i.e., $D_{12}$, $D_{14}$, $D_{61}$, $D_{18}$) of each ring can be the same or different. At the center of each layer, a disk 20 can optionally be nested with the innermost ring 18 to completely fill the available countermass space.

Figure 5:
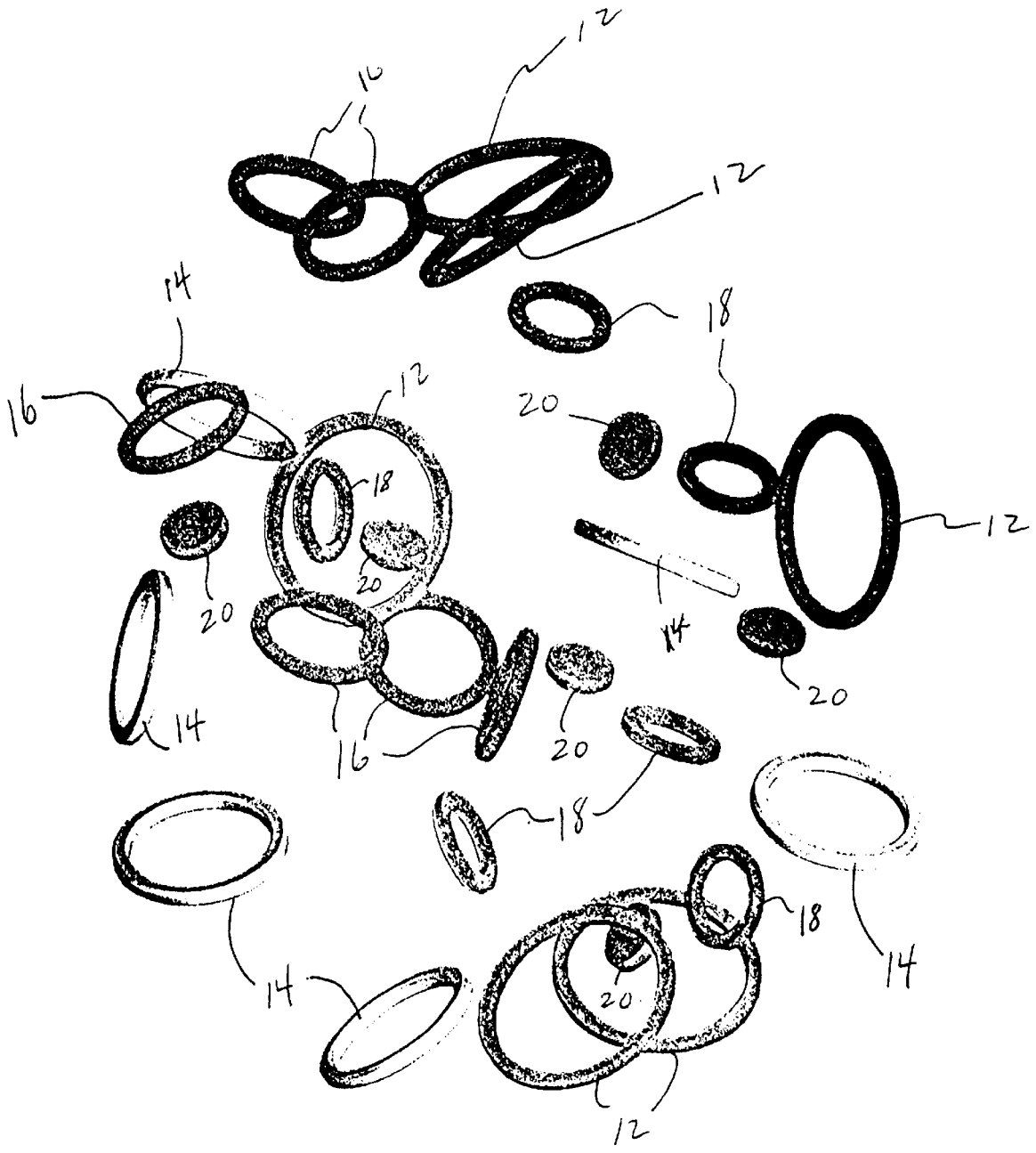
FIG. 5 is a perspective view of the countermass assembly of FIG. 4 once it has been released from its countermass tube.

Rings 12, 14, 16, 18 and disk 20 are positioned in a nested relationship as shown, and are maintained in countermass assembly 10 by means of the present invention's countermass tube (not shown). That is, the relationship between adjacent rings and ring 18/disk 20 is not a binding or press-fit relationship. In this way, when countermass assembly 10 is ejected into the surrounding environment, rings 12, 14, 16, 18 and disks 20 disperse and flutter due to their aerodynamically unstable shape as illustrated in FIG. 5.

Figure 6:
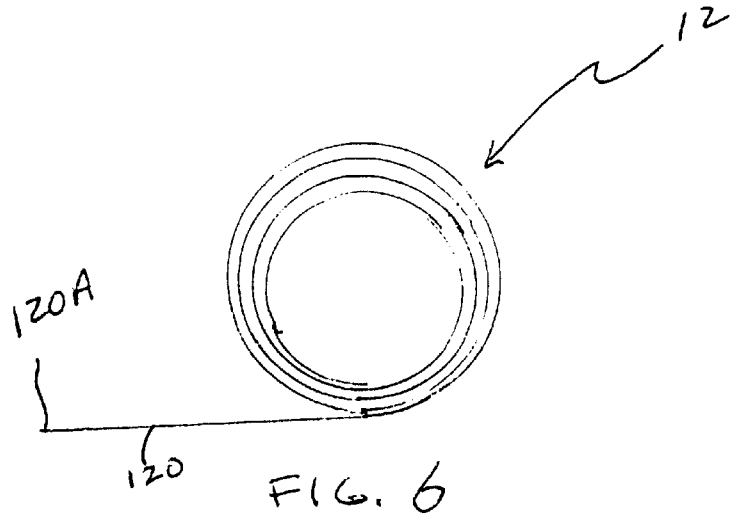
FIG. 6 is a side view of one ring constructed as a roll of a strip material.

Some or all of rings 12, 14, 16, 18 and disks 20 can be solid or can be made of a strip material that is wound similar to a roll of tape. For example, as illustrated in FIG. 6, one ring 12 is shown as being constructed of a strip 120. The outboard end 120A of strip 120 can be lightly tacked to the outermost winding of ring 12 to keep the ring configuration during assembly. When the rings (or disks 20) are constructed in this fashion, the strips will tend to unfurl as the rings and disks disperse. The unfurling of each ring and/or disk further slows their velocity as the unfurling strip material presents more surface area thereby increasing its aerodynamic instability.

Figure 7:
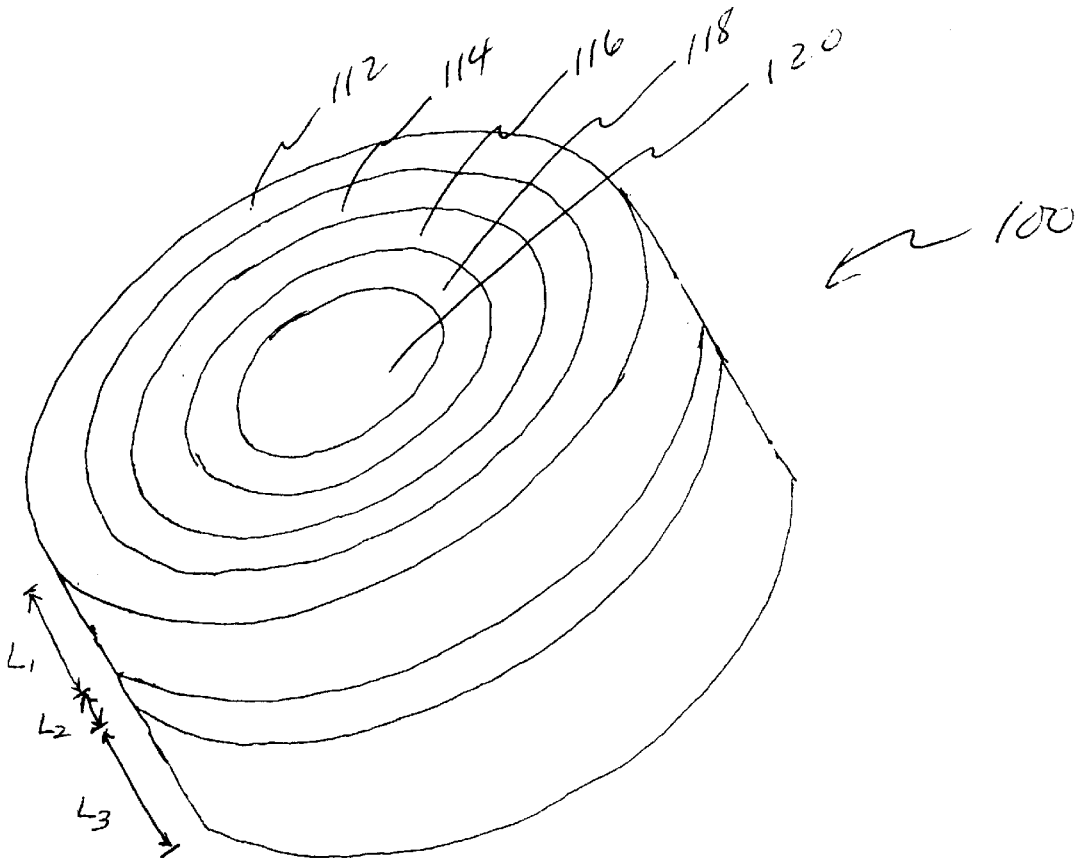
FIG. 7 is a perspective view of another embodiment of a stacked ring countermass assembly in which each layer of rings has a different axial length.

Each ring and disk in countermass assembly 10 has the same axial length. However, the present invention could also be made with layers of differing axial length as illustrated by countermass assembly 100 in FIG. 7. Specifically, a first layer of axial length $L_1$ consists of rings 112, 114, 116, 118 and disk 120. A second layer of similar rings/disk has an axial length $L_2$, and a third layer of similar rings/disk has an axial length $L_3$. These lengths can be selected so that the countermass disperses in an optimal fashion for a particular application. Note that the axial lengths could also successively increase, successively decrease, or be random in length depending on the application.

Figure 8:
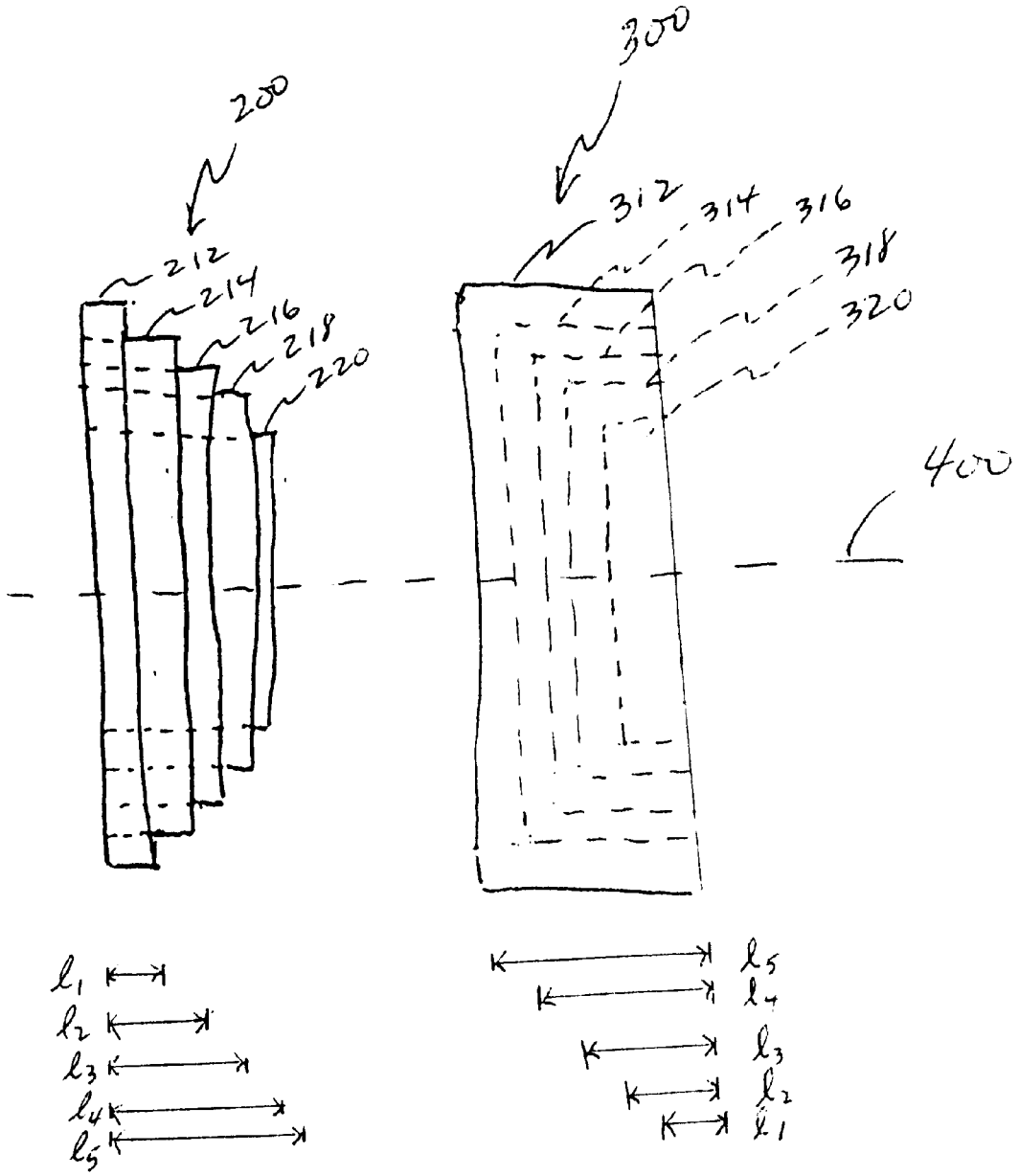
FIG. 8 is an exploded side view of another embodiment of a stacked ring countermass assembly in which adjacent layers of nested rings are radially interlocked.

The present invention could also be practiced by radially interlocking adjacent layers of nested rings as shown in the exploded view of FIG. 8. More specifically, layers 200 and 300 are shown separated from one another along a common longitudinal axis 400. As in the previous embodiments, each layer consists of nested rings with an optional central disk. However, the axial length of each ring/disk in a layer is varied to complement an adjacent ring/disk. For example, layer 200 has rings 212, 214, 216, 218 and disk 220 at its center. Layer 300 has rings 312, 314, 316, 318 and disk 320 at its center. The lengths of rings 212, 214, 216, 218 and disk 220 are $l_1$, $l_2$, $l_3$, $l_4$ and $l_5$, respectively. In a complementary fashion, the lengths of rings 312, 314, 316, 318 and disk 320 are $l_5$, $l_4$, $l_3$, $l_2$ and $l_1$, respectively. Thus, when layers 200 and 300 are pressed into axial engagement along axis 400, layers 200 and 300 will be radially interlocked with one another.

The advantages of the present invention are numerous. The recoilless projectile launcher system will disperse its harmless countermass without generating any side loading forces. This will result in increased safety for personnel and a more accurate launch. Further, the outermost launch tube should experience a longer useful life since it too will be spared from damaging side loading forces.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A recoilless projectile launcher system, comprising:

a launch tube open at muzzle and breech ends thereof;

a projectile residing in said launch tube, said projectile having a forward end pointing towards said muzzle end and having an aft end pointing towards said breech end;

a propellant charge coupled to said aft end of said projectile;

a first tube slidingly fitted in said launch tube, said first tube coupled to said aft end of said projectile and encasing said propellant charge, said first tube having a first portion extending from said propellant charge towards said breech end and having a second portion extending from said first portion towards said breech end, said first portion having a constant inside diameter and said second portion having a reduced inside diameter relative to said constant inside diameter of said first portion;

a piston slidingly fitted in said first portion of said first tube, said piston being positioned adjacent said propellant charge;

a second tube coupled to said piston and extending towards said breech end, said second tube having a constant inside diameter and a constant outside diameter wherein said constant outside diameter forms a sliding fit with said second portion of said first tube; and a dispersible countermass residing in said second tube, said dispersible countermass being dimensionally stable independent of said second tube.

2. A recoilless projectile launcher system as in claim 1, wherein said dispersible countermass comprises a plurality of disks arranged in a cylindrical stack, said cylindrical stack slidingly fitted in said second tube.

3. A recoilless projectile launcher system as in claim 1, wherein said dispersible countermass comprises a countermass assembly having a plurality of groups arranged axially adjacent one another to form a cylindrical stack having a common longitudinal axis, said cylindrical stack slidingly fitted in said second tube and each of said plurality of groups including a plurality of rings arranged in a nested interengagement.

4. A recoilless projectile launcher system as in claim 3 wherein at least a portion of said plurality of rings comprise a roll of strip material.

5. A recoilless projectile launcher system as in claim 3 further comprising a disk nested into a center of each of said plurality of groups.

6. A recoilless projectile launcher system as in claim 5 wherein at least a portion of said plurality of rings comprise a roll of strip material.

7. A recoilless projectile launcher system as in claim 5 wherein said disk comprises a roll of strip material.

8. A recoilless projectile launcher system as in claim 3 wherein axially adjacent groups from said plurality of said groups are radially interlocked with one another.

9. A recoilless projectile launcher system as in claim 8 wherein at least a portion of said plurality of rings comprise a roll of strip material.

10. A recoilless projectile launcher system as in claim 3 wherein an axial length of each of said plurality of groups is the same.

11. A recoilless projectile launcher system as in claim 10 wherein at least a portion of said plurality of rings comprise a roll of strip material.

12. A recoilless projectile launcher system as in claim 3 wherein an axial length of each of said plurality of groups is different.

13. A recoilless projectile launcher system as in claim 12 wherein at least a portion of said plurality of rings comprise a roll of strip material.

14. A recoilless projectile launcher system, comprising:

a first tube open at either end thereof;

a propellant charge mounted in said first tube;

a second tube slidingly fitted in said first tube and encasing said propellant charge, said second tube having a constant inside diameter portion extending from said propellant charge to a reduced inside diameter portion;

a piston slidingly fitted in said constant inside diameter portion of said second tube adjacent said propellant charge;

a third tube coupled to said piston and slidingly fitted in said reduced diameter portion of said second tube; and a dispersible countermass residing in said third tube, said dispersible countermass being dimensionally stable independent of said third tube.

15. A recoilless projectile launcher system as in claim 14, wherein said dispersible countermass comprises a plurality of disks arranged in a cylindrical stack, said cylindrical stack slidingly fitted in said third tube.

16. A recoilless projectile launcher system as in claim 14, wherein said dispersible countermass comprises a countermass assembly having a plurality of groups arranged axially adjacent one another to form a cylindrical stack having a common longitudinal axis, said cylindrical stack slidingly fitted in said third tube and each of said plurality of groups including a plurality of rings arranged in a nested interengagement.

17. A recoilless projectile launcher system as in claim 16 wherein at least a portion of said plurality of rings comprise a roll of strip material.

18. A recoilless projectile launcher system as in claim 16 further comprising a disk nested into a center of each of said plurality of groups.

19. A recoilless projectile launcher system as in claim 18 wherein at least a portion of said plurality of rings comprise a roll of strip material.

20. A recoilless projectile launcher system as in claim 18 wherein said disk comprises a roll of strip material.

21. A recoilless projectile launcher system as in claim 16 wherein axially adjacent groups from said plurality of said groups are radially interlocked with one another.

22. A recoilless projectile launcher system as in claim 21 wherein at least a portion of said plurality of rings comprise a roll of strip material.

23. A recoilless projectile launcher system as in claim 16 wherein an axial length of each of said plurality of groups is the same.

24. A recoilless projectile launcher system as in claim 23 wherein at least a portion of said plurality of rings comprise a roll of strip material.

25. A recoilless projectile launcher system as in claim 16 wherein an axial length of each of said plurality of groups is different.

26. A recoilless projectile launcher system as in claim 25 wherein at least a portion of said plurality of rings comprise a roll of strip material.

* * * * *